United States Patent [19]

Adkins

[11] Patent Number: 4,602,605

[45] Date of Patent: Jul. 29, 1986

[54] ENTERING FUEL INJECTION SYSTEM OF A DIESEL ENGINE

[76] Inventor: James L. Adkins, P.O. Box 7390, Tamuning, Guam 96911-1390

[21] Appl. No.: 692,728

[22] Filed: Jan. 18, 1985

Related U.S. Application Data

[63] Continuation-in-part of Ser. No. 577,549, Feb. 6, 1984, abandoned.

[51] Int. Cl.[4] ..... F02M 59/00

[52] U.S. Cl. ..... 123/516; 123/198 D

[58] Field of Search ..... 123/516, 510–514, 123/198 DB, 198 D

[56] References Cited

U.S. PATENT DOCUMENTS

| | | | |
|---|---|---|---|
| 2,323,525 | 7/1943 | Ebel et al. | 123/516 |
| 3,612,021 | 10/1971 | Ross | 123/510 |
| 4,124,013 | 11/1978 | Rivalto | 123/198 DB |
| 4,320,734 | 3/1982 | Balachandran | 123/516 |
| 4,372,847 | 2/1983 | Lewis | 123/510 |

FOREIGN PATENT DOCUMENTS

| | | | |
|---|---|---|---|
| 2651459 | 5/1977 | Fed. Rep. of Germany | 123/516 |
| 581319 | 11/1977 | U.S.S.R. | 123/198 DB |

*Primary Examiner*—Magdalen Y. C. Greenlief
*Attorney, Agent, or Firm*—Owen, Wickersham & Erickson

[57] ABSTRACT

An automatic shut off device for preventing air from entering the fuel system of an internal combustion engine when the fuel supply becomes low. The device provides a fuel chamber having an inlet connected to a fuel supply line, a float switch and an outlet connected to the engine fuel pump or fuel system. When the fuel supply falls below a preselected low level, but before the level reaches a lower inlet to a standpipe, the float switch is actuated to shut down the engine before air can enter the engine fuel system, thereby eliminating the necessity of bleeding the fuel system when the fuel supply is restored. A bleed orifice at the top of the fuel chamber allows trapped air to escape and return to the fuel tank when fuel is restored to the device.

4 Claims, 8 Drawing Figures

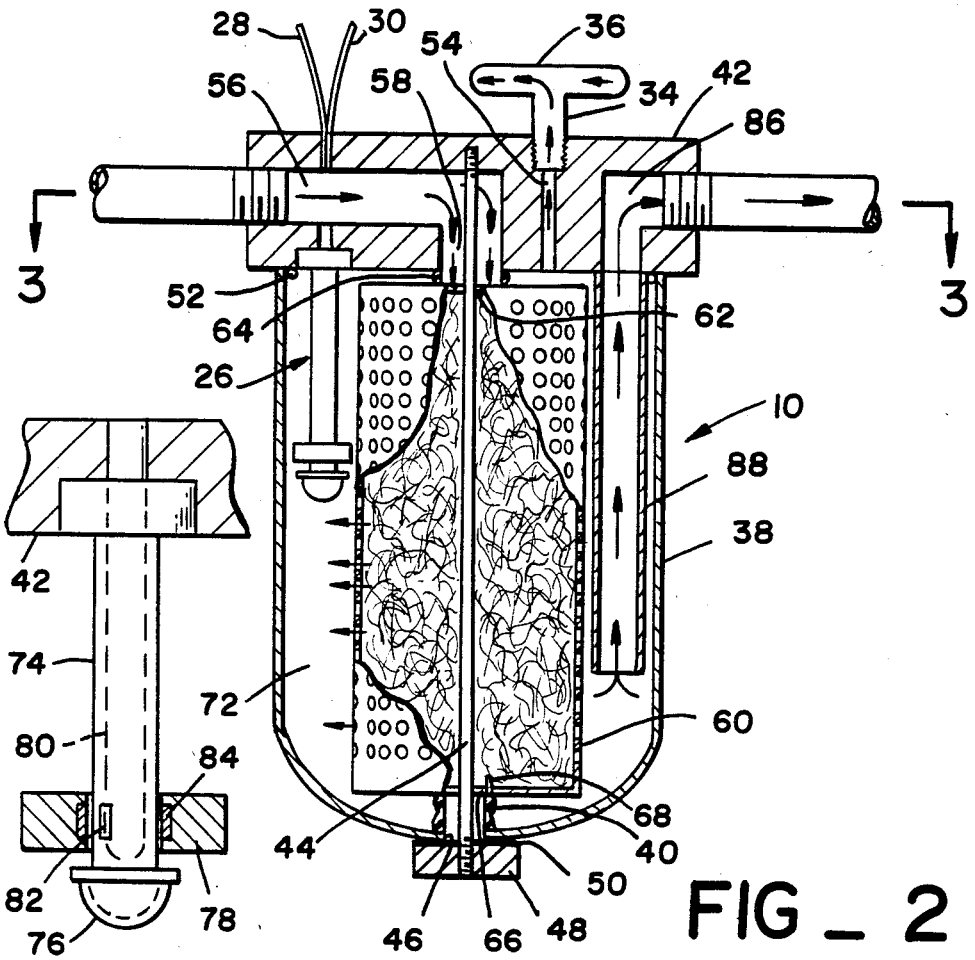
FIG _ 2
FIG _ 4
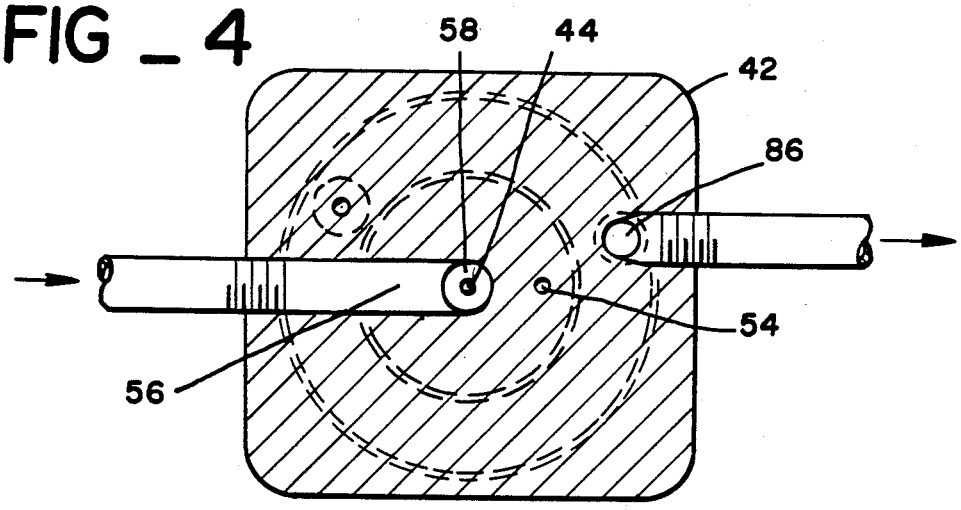
FIG _ 3

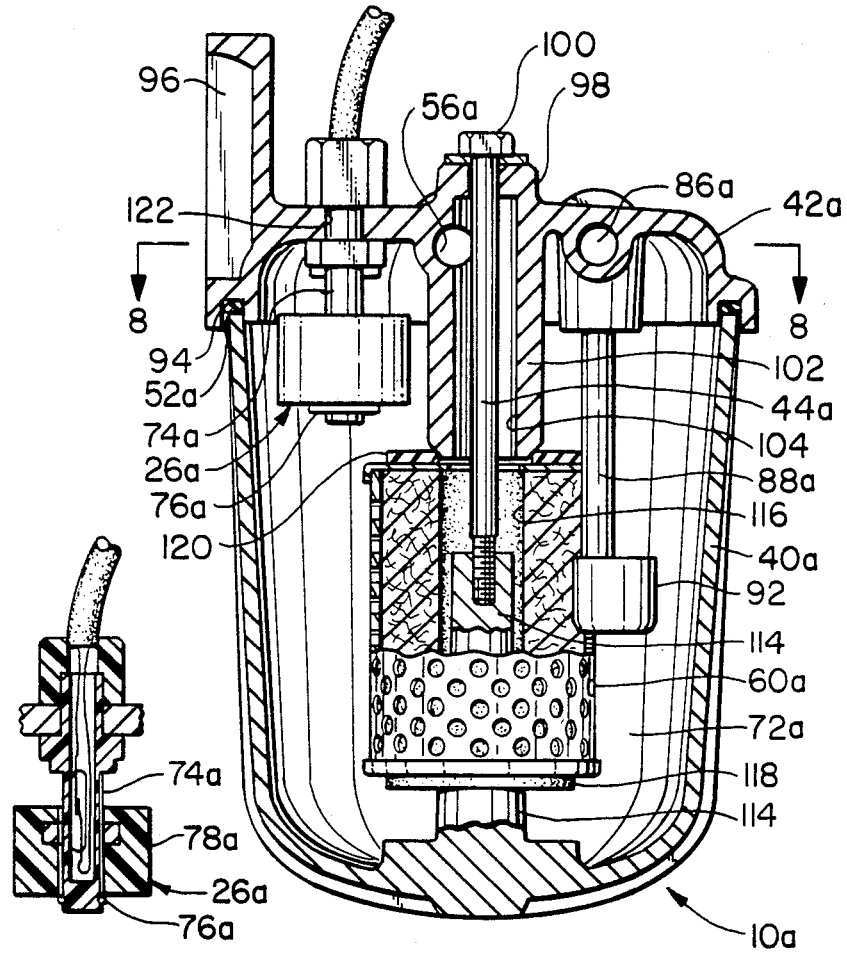
FIG_5
FIG_6
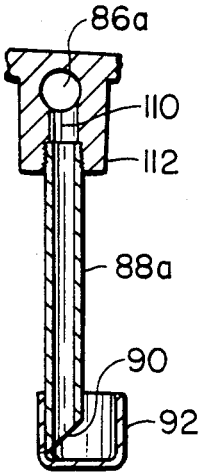
FIG_7
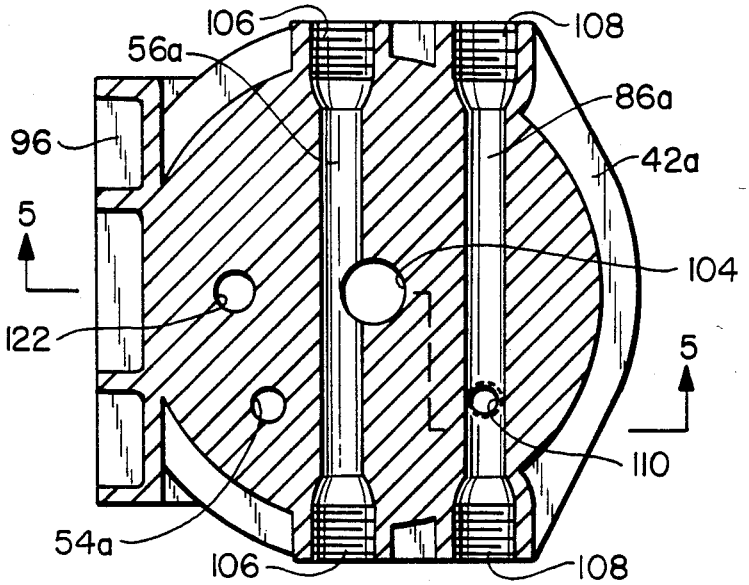
FIG_8

ENTERING FUEL INJECTION SYSTEM OF A DIESEL ENGINE

CROSS-REFERENCE TO RELATED APPLICATION

This application is a continuation-in-part of application Ser. No. 577,549, filed on Feb. 6, 1984 and now abandoned.

BACKGROUND OF THE INVENTION

This invention relates to fuel systems for internal combustion engines and more particularly to a device for preventing air from entering a fuel system when the fuel supply runs low.

In the operation of internal combustion engines, particularly diesel engines, the presence of air in the fuel system can cause serious performance problems or even failure of the engine to continue functioning or to start. Heretofore, such problems often occurred when the fuel supply of an operating engine was not monitored and became exhausted, causing the engine to suck air into its fuel system. To restart an engine under such circumstances usually required complicated and time-consuming procedures in order to bleed air from the entire fuel system which was necessary to restore normal operation. Often, before such proper procedures were applied, efforts to start the engine caused other problems such as burned out starters and de-energized batteries.

A general object of the present invention is to solve this problem so that the fuel supply of an operating engine need not be monitored and if the fuel is depleted, the engine will automatically shut down before any air can enter the engine fuel system.

Another object of my invention is to provide a device that can be easily installed between the fuel system of an engine and its fuel supply which will automatically shut down the engine when the fuel supply is diminished to a predetermined level.

Another object of my invention is to provide an automatic engine turn-off device comprising a housing which may be installed between the fuel system of an internal combustion engine and its fuel supply and having filter means and switch means that will operate to stop the engine when the level of filtered fuel in the housing falls to predetermined level.

Yet another object of the present invention is to provide a compact automatic engine turn off device that will operate automatically to trap any entrained air in the fuel and return it to the fuel supply tank and then shut off the engine if the fuel supply falls below a predetermined level before air can enter the engine fuel system.

Another object of the invention is to provide an automatic engine turn-off device which will prevent air from entering the fuel system of an engine when the fuel supply becomes exhausted and even if it becomes necessary to disassemble the device to replace a component such as a filter element.

Another object of my invention is to provide an automatic engine shut down device for preventing air from entering the engine fuel system, which is particularly well adapted for ease and economy of manufacture.

SUMMARY OF THE INVENTION

In accordance with the invention, a housing is provided having an inlet connectable to an engine fuel tank and an outlet connected to an engine fuel system which may include a fuel line pump, a fuel injection pump and injectors, as on a diesel engine. The inlet to the housing is located at or near its upper end; and the outlet takes fuel from near the bottom of the housing by means of an internal standpipe. Within the housing and near its upper end is a float switch having a buoyant element which is maintained in an up position when the housing is normally full of fuel. With the switch element in the up position the engine remains in normal operating condition. When the fuel supply is depleted in the supply tank, the switch element is lowered with the fuel level and a circuit is closed which operates a relay or solenoid switch that shuts off the engine. Since this engine shut off occurs before the fuel level in the housing reaches the lower end of the standpipe for the outlet, no air is allowed to reach the engine fuel system including the injectors. When the fuel supply tank is refilled, the housing is again filled with fuel and the switch element moves again to its up position which allows the engine to operate normally. In the preferred arrangement for the invention, the housing also contains a filter element so fuel from the inlet is filtered before it leaves the housing. Fuel entering the housing is thus filtered first before flowing into an annular space surrounding the filter cartridge and containing the float switch. Filtered fuel leaves the housing through a standpipe that extends downwardly from an outlet alongside the filter element. A cup-like end member is attached to the lower end of the standpipe to retain a quantity of fluid and thereby prevent air from entering the standpipe even when it becomes necessary to disassemble the device. An air bleed orifice in the upper end of the housing connects the annular space around the filter with a fuel return line extending from the engine to its supply tank. Thus, any air trapped within the housing is removed from the filtered fuel and returned to the engine supply tank.

Other objects, advantages and features of the invention will become apparent from the following detailed description presented in conjunction with the accompanying drawing.

BRIEF DESCRIPTION OF THE DRAWING

FIG. 2 is a view in elevation and in section showing the engine shut off device included in the system of FIG. 1.

FIG. 3 is a plan view of the device shown in FIG. 2.

FIG. 4 is an enlarged view in elevation and in section of the float switch for the device of FIG. 2.

FIG. 5 is a view in elevation and in section of a modified engine shut off device according to the invention and taken at line 5—5 of FIG. 8.

FIG. 6 is a view in section of a modified form of float switch used for the device of FIG. 5.

FIG. 7 is a fragmentary view in section showing the device of FIG. 5 with its standpipe and liquid retainer also in section.

FIG. 8 is a top view in section of the device shown in FIG. 5, taken along line 8—8 thereof.

DETAILED DESCRIPTION OF PREFERRED EMBODIMENT

Figure 1:
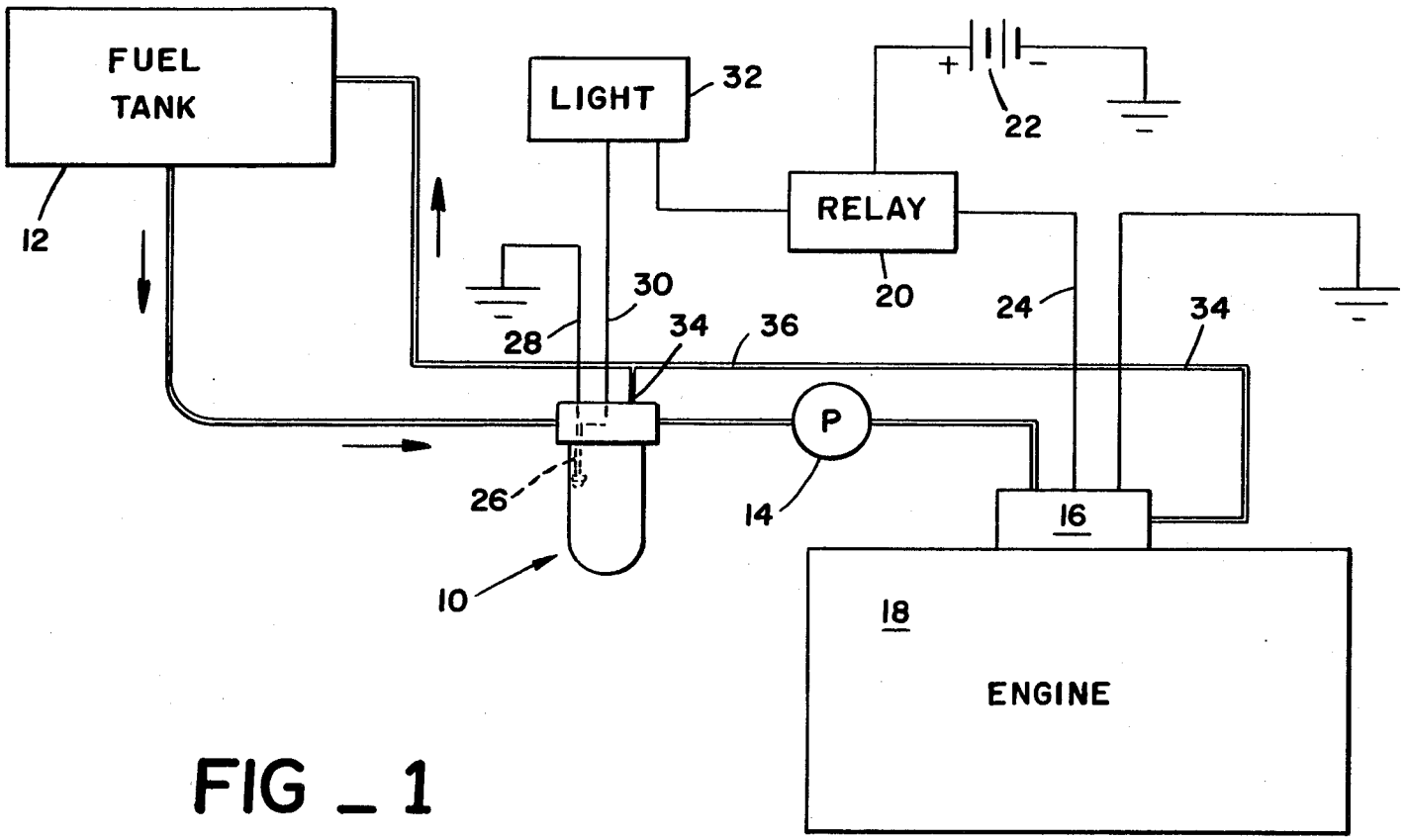
FIG. 1 is a schematic diagram of a typical engine fuel supply system utilizing an automatic engine shut off device according to the present invention.

With reference to the drawing, FIG. 1 shows schematically a typical engine fuel system utilizing an automatic fuel shut off device 10 embodying principles of the present invention and operable to prevent air from entering the fuel system when the fuel supply is exhausted. In the fuel system shown, a fuel tank 12 is connected to the device 10 whose outlet is connected to a pump 14 and then to an injection system designated generally by numeral 16 which normally includes injectors and injection pumps for an engine 18. This injection system also is provided with conventional cutoff valves for the injectors which are used to stop the engine. A relay 20 is provided which is connected to a battery 22 and has an output lead 24 connected to the fuel injection system 16 and to the injector cutoff valves therein. Such a relay in a typical engine system may also be connected to other engine sensors such as an oil temperature sensor and/or an engine RPM sensor (not shown). As a safety measure, such sensors will provide a shutdown signal to the relay when safe engine operating limits are exceeded. The relay, when actuated by such sensors will cause the injector cutoff valves to close. In the present invention, the relay 20 operates in the same manner in response to the device 10 to shut down the engine when the fuel supply is exhausted, but before air can enter the engine fuel system. Thus, within the device 10 is a float switch 26 which is connected by a lead 28 to ground and by a lead 30 through an indicator light 32 to the relay. An air bleed orifice is also provided in the device 10 and connects via a fitting 34 with a fuel return line 36 extending from the engine fuel injection system back to the fuel tank.

As shown in FIG. 2, one embodiment of the device 10 comprises a generally cylindrical housing 38 with a closed lower end member 40 that forms a bowl-like receptacle for fuel. This housing may be formed from a suitable thin-walled metal material. At its upper end, the housing is attached to a cover member 42 that is relatively thick and may be made of plastic or metal material. The cover member is secured to the housing by an assembly bolt 44 which is threadedly attached at its upper end to the cover member and extends downwardly along the central axis of the housing. The lower end of the bolt 44 extends through an opening 46 in the lower housing member 40 and is attached to a water and sediment trap or drain 48. A gasket 50 is provided between the drain 48 and the opening 46 and another annular gasket 52 is provided around the upper edge of the housing between it and the cover member 42, so that when the assembly bolt is in place and tightened within the cover member, the housing will become fluid tight except for its inlet and outlets.

Within the cover member 42 is an orifice 54 for bleeding air that extends transversely through it from its bottom surface to its upper surface. Attached to this orifice is the fitting 34 which connects with the return line 36 from the engine fuel injectors to the fuel tank. This orifice 54 allows air to escape from the housing when it is being filled with liquid such as diesel fuel.

The fuel inlet to the device is through an orifice 56 that extends radially inwardly to the center axis of the cover member 42 and surrounds the assembly bolt 44, forming a central liquid passage 58 into the housing 38.

In order to assure that only clean fuel will flow to the engine, a suitable filter cartridge 60 having the conventional cylindrical configuration is situated within the housing. At its upper end this cartridge has an opening 62 that is aligned with the passage 58 and a gasket 64 is provided to form a fluid seal between the cover member 42 and the cartridge 60. At its lower end the cartridge has an opening 66 aligned with the housing opening 46 to facilitate the periodic removal of water and sediment trapped in the filter. A short annular member 68 fixed to the inside of the housing bottom around its opening projects axially and is adapted to fit within the lower cartridge opening 46. A gasket 40 around this latter opening forms a fluid seal between the lower end of the filter cartridge and the annular member 68.

The filter cartridge 60 may be of a commercially available type having an outer wall member with a multiplicity of perforations and containing a suitable filtration media of a type commonly used in fuel filters such as folded paper or an unwoven fibrous material. The filter has an overall diameter considerably smaller than that of the housing so that an annular space 72 is provided around it. Attached to the cover body and extending downwardly from it into the annular space is the fuel level float switch 26.

In the form shown in FIG. 4, the switch 26 comprises a tubular member 74 that is anchored in and extends below the bottom surface of the cover member 42. At its lower end is an enlarged cap 76 that forms a stop for an annular buoyant member 78 that fits loosely around the tubular member. A conductive lead 80 extends through the cover body and downwardly through the tubular member 74, forming a loop at its bottom end just above the cap 76. At or near this loop, a magnetically sensitive element 82 such as a magnetic reed is provided in the lead 80. The buoyant member 78 is provided with a magnetic ring 84 on its inner annular surface which is adjacent to the outer surface of the tubular member 74. Normally, the element 82 in the conductive lead 80 maintains an open circuit, but when the buoyant member 78 is lowered by the fuel level, the magnetic field of its ring 84 causes the element 82 to conduct so that current flows in the conductor 80. This conductor extends from the cover body of the device 10 as leads 28 and 30, as previously described with reference to FIG. 1.

On the other side of the cover member 42 from the inlet orifice 56 is an outlet orifice 86 which extends radially inward from its periphery and then turns at a right angle to provide an outlet passage from the housing. Attached to the inner end of this outlet orifice is a standpipe 88 that extends downwardly within the annular space 72 to near the bottom end of the filter cartridge 60 in the housing. Thus, the standpipe is situated on the opposite side of the filter cartridge from the float switch 26 to receive filtered fuel at its lower end well below the fuel level in the housing.

In operation, when the fuel supply is ample, the housing including the annular space around the filter cartridge is filled with fuel that flows through the inlet 56, through the filter 60, up through standpipe 88 and out through the outlet 86 to the engine fuel injection system 16. Under this normal condition, the float member 76 of the switch 26 is in its normal up position and no current is flowing in the conductor 80, so that normal engine operation is maintained. Any air which accumulates in the housing from incoming fuel is forced out through the vent outlet 54 and back to the fuel supply tank via the line 36. Now, if the fuel supply runs low, the fuel level will lower within the annular space surrounding the filter within the housing. The float member 78 will fall with the fuel level until it reaches the lower stop member 76. When this occurs, the magnetic ring 84 will cause the element 82 to conduct and a signal is immediately supplied to the engine cutoff mechanism 16, thereby causing the engine to stop. This engine shut off occurs rapidly after the float member falls and long before the fuel level in the housing can fall further to the level of the lower inlet end of the standpipe within the housing. Hence, the continuous stream of liquid fuel to the engine fuel system is maintained and no air is allowed to enter it. More importantly, when the engine is restarted, no complicated time consuming procedures are necessary to bleed air from the engine fuel system. When more fuel is supplied to the fuel tank, the housing will again fill up causing the float member to rise and maintain its proper operating contact with the switch sensor, thereby allowing the engine to run normally.

In addition to the automatic engine shutoff feature described above, the present invention is also constructed so as to prevent air from entering the fuel line whenever it becomes necessary to disassemble the device for any reason, as, for example, to replace the filter cartridge. A somewhat modified device 10*a* embodying principles of the present invention is shown in FIGS. 5 to 8 and includes the aforesaid feature. As shown in FIG. 5, here the outlet standpipe 88*a*, which is connected to the outlet orifice 86*a* and extends downwardly into the annular space 72*a* has a lower end portion that forms a reverse liquid flow path which is open upwardly. In this embodiment, the lower end 90 of the standpipe is beveled at approximately a 45° angle to its longitudinal axis, (see FIG. 7) and is attached to a liquid retainer 92. Preferably, this retainer is essentially a cylindrical cup with a somewhat larger diameter than the standpipe. The beveled end portion of the standpipe extends within and is bonded or brazed to the inner surface of the retainer cup along one side thereof. Thus, the only opening to the lower end of the standpipe is the upwardly directed opening of the retainer cup which thus serves as a liquid trap. When the housing is disassembled, for example, to provide access to the filter cartridge, a quantity of fuel is always trapped and remains in the retainer 92. Therefore, all of the fuel cannot flow out of the standpipe 88*a* and no air is allowed to enter the fuel line through it. Instead, liquid is always retained within the standpipe and remains at the level of the upwardly faced opening of the retainer cup at its lower end portion. Once a new filter cartridge has been installed and the housing shell is replaced, the device 10*a* can be filled again with liquid. As fuel flows into it through the housing inlet 56*a*, air within the annular chamber 72*a* is forced out through a vent 54*a* in the cover member, and once the annular chamber 72*a* is filled with fuel above the retainer 92, it will flow freely without air bubbles through the outlet 86*a* and the fuel line to the engine. Consequently, it is seen that a quick change of the filter cartridge can be made without contaminating the fuel line and thus the engine injectors with air.

The embodiment 10*a* shown in FIGS. 5 to 8 has other additional structural modifications which differ from the embodiment of FIGS. 2–4 and enhance its ease of manufacture and assembly. For example, the housing here is comprised of two components namely an upper cover member 42*a* and a lower bowl member 40*a*. The cover member with a generally circular shape is formed with a circular groove 94 to receive the upper edge of the bowl member, a rubber gasket 52*a* being provided within the groove to seal these components when assembled. An integral bracket 96 is provided in one side of the cover to facilitate mounting of the device. The cover is provided with a central boss with an outer portion 98 which provides a seat for the head end 100 of an elongated bolt 44*a*. An inner portion 102 of the central boss has a cylindrical chamber 104 and extends downwardly into the bowl member 40*a*. The chamber is intersected by the inlet passage 56*a* that extends transversely through an enlarged portion of the cover member 42*a*. As shown in FIG. 8, this passage has threaded openings 106 at opposite ends, so that one end can be selected as most convenient and connected to the fuel supply line (from the tank 12) and the other end can be plugged. Another passage 86*a* extends parallel to the fuel inlet passage through the cover member and similarly has threaded end portions 108 at opposite ends. When the device is installed, one of the latter end portions (which is most conveniently located) can be connected to the fuel line to the engine, while the other end portion is plugged. This latter passage 86*a* communicates with a branching passage 110 through a downwardly extending boss member 112 to which the standpipe 88*a* is threadedly attached (FIG. 7).

At the bottom inner end of the bowl member 40*a* is a tapered boss member 114 that extends axially upwardly and terminates at a distance from the inner central boss 102 on the cover member. The filter cartridge 60*a* which is of the annular type with a central axially extending bore 116, fits over the tapered boss member. An annular gasket 118 at the lower end of the filter cartridge forms a seal at the point where the diameter of the boss member equals the diameter of the central bore. As shown in FIG. 5, when the device 10*a* is assembled, the central annular boss 102 on the cover member presses against an annular elastomeric washer 120 on the upper end of the filter cartridge. The main assembly bolt 44*a* extends through the central boss and threadedly engages the upper end of the lower boss 114 in the bowl member. As the bolt 44*a* is tightened, the bowl member is drawn tightly into the cover member, the central boss is sealed against the upper end of the filter cartridge, and the lower end of the filter cartridge is sealed against the tapered boss portion 114. Thus, it is seen that liquid, i.e., fuel flowing into the device 10*a* via the inlet passage 56*a*, through the boss chamber 104, enters the inner bore 116 of the filter cartridge. Filtered fuel flows out the perforated side walls of the filter and fills the annular space 72*a* surrounding it within the housing.

In normal operation, fuel flows out of the device 10*a* through the standpipe 88*a* and through the passage 86*a* to the engine while the float 78*a* of the switch 26*a* is normally forced upwardly. In the device 10*a*, a somewhat shorter float switch 26*a* with a relatively larger float member is used and it extends downwardly through an opening 122 in the cover member, into the space outside of but just above the top of the filter element, as shown. This provides access for leads from the float switch. Again, this float switch may be of the commercially available type as previously described, such as one manufactured by Nohken Co., Ltd., and it operates in essentially the same manner as switch 26, as previously described. Thus, if fuel in the supply tank becomes depleted, the fuel level in the device 10*a* will fall, causing the float 78*a* of the switch to lower and thereby actuate the engine cutoff relay. The embodiment of FIGS. 5–8 provides a fuel shut off device that operates as described with reliability and is particularly well adapted for economy of manufacture and ease of maintenance.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

What is claimed is:

1. In a fuel system for an internal combustion engine having fuel injection means with cutoff means, relay means connectable to one or more engine sensors and to said cutoff means, a fuel supply tank, an automatic engine air removal and a shut off device located outside said fuel supply tank and comprising:

housing means forming a fuel chamber having an inlet passage adapted to be connected to said fuel supply having an outlet passage adapted to be connected to said engine fuel injection means;

conduit means connected to said outlet passage and extending downwardly therefrom within said fuel chamber, said conduit means having an inlet at its lower end located below said inlet passage and;

means within said chamber for sensing the level of fuel therein and for providing a signal to said relay means for stopping the engine when the fuel in said tank becomes exhausted but before the fuel in said chamber reaches a predetermined lower level within said chamber, thereby preventing air from entering said fuel injection means of the engine fuel system and;

fluid retainer means at the lower end of said conduit means within said chamber for holding a quantity of fuel and thereby preventing air from entering said conduit means even if the level of fuel in said chamber should fall below the end of said conduit means.

2. The device as described in claim 1 wherein said fluid retainer means comprises a cup-like receptacle surrounding the end of and fixed to one side of said conduit means.

3. In a fuel system for an internal combustion engine having fuel injection means with cutoff means, relay means connectable to one or more engine sensors and to said cutoff means, a fuel supply tank, an automatic engine air removal and a shut off device located outside said fuel supply tank and comprising:

housing means forming a fuel chamber having an inlet passage adapted to be connected to said fuel supply and having an outlet passage adapted to be connected to said engine fuel injection means;

conduit means connected to said outlet passage and extending downwardly therefrom within said fuel chamber, said conduit means having an inlet at its lower end located below said inlet passage;

means within said chamber for sensing the level of fuel therein and for providing a signal to said relay means for stopping the engine when the fuel in said tank becomes exhausted but before the fuel in said chamber reaches a predetermined lower level within said chamber, thereby preventing air from entering said fuel injection means of the engine fuel system and;

means forming an air relief passage from an upper end of said chamber adapted to connect with a return line to said fuel supply tank including an orifice extending through said housing means located near said outlet passage.

4. In a fuel system for an internal combustion engine having fuel injection means with cutoff means, relay means connectable to one or more engine sensors and to said cutoff means, a fuel supply tank, an automatic engine air removal and shut-off device located outside of said fuel supply tank and comprising:

housing means forming a fuel chamber having an inlet passage adapted to be connected to said fuel supply and having an outlet passage adapted to be connected to said engine fuel injection means;

conduit means connected to said outlet passage and extending downwardly therefrom within said fuel chamber, said conduit means having an inlet end located below said inlet passage;

and a float switch within said chamber for sensing the level of fuel therein and for providing a signal to said relay means for stopping the engine when the fuel in said tank becomes exhausted but before the fuel in said chamber reaches a predetermined lower level within said chamber, thereby preventing air from entering said fuel injection means of the engine fuel system, said float switch comprising a tubular member that extends to a predetermined depth in said chamber, a conductor in said tubular member having a magnetically sensitive element at its bottom end which conducts current only when subjected to a magnetic field, and a buoyant member adapted to move up and down with the level of fuel in said chamber and having a magnet attached thereto, whereby when the fuel level in the chamber falls and reaches that of said sensitive element, current can flow in said conductor to provide a shut off signal to said fuel injection means.

* * * * *